US006192904B1

(12) United States Patent
Secknus et al.

(10) Patent No.: US 6,192,904 B1
(45) Date of Patent: Feb. 27, 2001

(54) FLEXIBLE LANCE FOR MACHINING OR INSPECTING A TUBE BOTTOM OF A STEAM GENERATOR

(75) Inventors: Otto Secknus, Eggolsheim; Rudolf Henglein, Pinzberg, both of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 08/931,547

(22) Filed: Sep. 15, 1997

Related U.S. Application Data

(63) Continuation of application No. PCT/DE96/00449, filed on Mar. 13, 1996.

(30) Foreign Application Priority Data

Mar. 15, 1995 (DE) ..... 195 08 802

(51) Int. Cl.[7] ..... B08B 9/00

(52) U.S. Cl. ..... 134/167 R; 134/172; 134/198; 134/113; 122/392; 239/752

(58) Field of Search ..... 122/382, 392; 134/167 R, 177, 200, 175, 172, 198, 43, 180, 181, 113; 239/753, DIG. 13, 588, 210, 195, 750, 752

(56) References Cited

U.S. PATENT DOCUMENTS

| | | | | |
|---|---|---|---|---|
| 3,908,756 | * | 9/1975 | Richardson | 165/158 |
| 4,407,236 | | 10/1983 | Schukei et al. . | |
| 4,638,667 | * | 1/1987 | Zimmer | 73/432.1 |
| 4,980,120 | * | 12/1990 | Bowman | 376/316 |
| 5,036,871 | * | 8/1991 | Ruggieri | 134/167 R |
| 5,065,703 | * | 11/1991 | Lee | 122/382 |
| 5,116,358 | * | 5/1992 | Granger | 606/224 |
| 5,194,217 | * | 3/1993 | St. Louis | 376/316 |
| 5,286,154 | * | 2/1994 | Jens | 414/7 |
| 5,411,043 | * | 5/1995 | Kamler | 134/167 R |

FOREIGN PATENT DOCUMENTS

| | | |
|---|---|---|
| 0 077 255 A1 | 4/1983 | (EP) . |
| 0 084 867 A1 | 8/1983 | (EP) . |
| 2 544 123 | 10/1984 | (FR) . |
| 88/07156 | 9/1988 | (WO) . |

* cited by examiner

*Primary Examiner*—Frankie L. Stinson
(74) *Attorney, Agent, or Firm*—Herbert L. Lerner; Laurence A. Greenberg; Werner H. Stemer

(57) ABSTRACT

A flexible lance for machining or inspecting a tube bottom of a steam generator includes a flexible metallic strip which has recesses disposed one after the other in its longitudinal direction. A flexible supply line is threaded through the recesses and a machining or inspection head is disposed on a free end of the strip.

7 Claims, 10 Drawing Sheets

FLEXIBLE LANCE FOR MACHINING OR INSPECTING A TUBE BOTTOM OF A STEAM GENERATOR

CROSS-REFERENCE TO RELATED APPLICATION

This application is a continuation of International Application Ser. No. PCT/DE96/00449, filed Mar. 13, 1996.

BACKGROUND OF THE INVENTION

Field of the Invention

The invention relates to a flexible lance for machining or inspecting a tube bottom of a steam generator.

Endoscopic inspections of tube bottoms of steam generators demonstrate that in regions which have a poor flow of water of a secondary circuit through them, adhering impurities are left behind, having a height in some places that can be a few centimeters.

Such deposits are called kidney deposits due to the geometric shape of their distribution on the tube bottom. They are produced because loose deposits are left behind in an inner region of the heating tube bundle which has a poor flow therethrough, while in an outer region which has a better flow therethrough, they are entrained with the flow of a secondary side feed-water current. The deposits adhere to the tube bottom in an increasingly stronger manner as the operating duration rises. As a result of further depositing processes in the course of a number of operating cycles, deposit conglomerates grow in an expanse of a number of centimeters and have an increased metal and salt quantity concentration in comparison to loose impurities.

Analyses of those hard deposit conglomerates show a mixture composition that is essentially formed of magnetite. Besides other oxidation stages of iron, there are also increased salt quantity concentrations, in particular sulfates, silicates, and phosphates. Likewise increased chromium and nickel ratios are produced due to the depositing of metal shavings. The mechanical hardness in some places can exceed the hardness of the heating tube material so that when the growth is limited spatially, there is the danger of damage to the heating tubes, such as denting.

For that reason, examinations must be regularly carried out on the secondary side of tube bottoms of steam generators as to whether or not and in what quantity deposits have built up between the heating tubes. The deposits must then be removed in order to prevent damage to the heating tubes.

In the case of the adhering deposits, removal takes place primarily through the use of spray processes. However, intermediary spaces between the heating tubes can only be reached with difficulty due to the small tube spacing. The spacing is usually approximately 8 to 11 mm when the heating tubes are in a square configuration and can be between 3 and 4 mm in tighter triangular configurations. For that reason, chiefly spray processes are used, which have been disclosed, for example, in Published European Patent Application 0 084 867 A1, corresponding to U.S. Pat. Nos. 4,572,284 and 4,487,165. In that spray process, a high-pressure water jet is sprayed into the intermediary spaces between the heating tubes by a spray head disposed in a tube channel.

However, it has been found that deposits adhering in the inner region of the tube bundles can only be partially removed in that manner. In order to assure an efficient cleaning of the tube bottom, it is therefore necessary to guide a spray head directly into the intermediary spaces between the heating tubes and to aim a high pressure jet of fluid directly at the deposits inside the heating tube bundles.

A device which is suited therefor has been disclosed, for example, in Published European Patent Application 0 305 483, corresponding generally to Published International Patent Application WO 88/07156 and U.S. Pat. No. 5,065,703. The device disclosed therein includes a flexible spray lance which has a spray head on its free end, with a multiplicity of nozzles from which the spray fluid emerges. The flexible spray lance is formed of a flexible strip in which conduits are disposed that have circular cross sections. Metallic capillaries are inserted into the conduits through which the spray fluid is guided to the spray head. The strip and the conduits are produced in one piece out of a plastic through the use of extrusion.

The strip is supported in a rigid guide having a bent end with which it can be deflected by a predetermined angle. The rigid guide is supported in a transport device which is inserted into the tube channel of the steam generator and can travel along the tube channel. In order to drive the strip, a number of jointly driven gears are provided, having teeth which engage in corresponding perforations of the strip. The free end of the spray lance is oriented toward the tube gaps due to the bent end of the rigid guide.

However, the stability is limited with greater free arm length due to the use of a plastic with capillaries embedded in the longitudinal direction.

U.S. Pat. No. 5,036,871 has disclosed a device for cleaning the tube bottom in which a flexible strip is provided in lieu of a spray lance formed of a one-piece flexible strip. The flexible strip is composed of a multiplicity of individual members connected to one another, through which a high pressure hose is guided. In addition, a cable can be incorporated into this strip to increase its stability. Such a segmented strip is also used in the devices disclosed in U.S. Pat. No. 5,065,703 and U.S. Pat. No. 5,286,154 for inspecting and machining the tube bottom, in which an inspection lens system and mechanical machining tools, for example a drill or grasping mechanism, are used on a machining head. However, in order to be able to receive high pressure spray capillaries, the segments which are connected to one another are wide enough to ensure that very narrow tube gaps of the kind found in triangularly disposed heating tube bundles, can no longer be navigated.

U.S. Pat. No. 4,407,236 has disclosed a flexible spray lance which is formed of a spring steel strip, on which one or a number of capillaries for the spray fluid are fastened to one side. The capillaries are laid in a wavy manner and at the free end of the strip, they feed in a downwardly directed manner into a semicircular recess on the underside of the strip so that the spray fluid coming from them is directed downward onto the tube bottom. The strip is guided with its narrow sides into grooves in a top and bottom plate, which are introduced into the tube channel of the steam generator. The groove in the bottom plate causes a deflection of the strip onto a tube gap. The driving of the strip is carried out by a transverse force exerted on the strip from behind. That produces a high rigidity of the strip and in addition, is only possible in steam generators in which an inspection port is disposed at the same level as the tube channel.

SUMMARY OF THE INVENTION

It is accordingly an object of the invention to provide a flexible lance for machining or inspecting a tube bottom of a steam generator, which overcomes the hereinaforementioned disadvantages of the heretofore-known devices of this general type and which can also be inserted into narrow tube gaps.

With the foregoing and other objects in view there is provided, in accordance with the invention, a flexible lance for machining or inspecting a tube bottom of a steam generator, comprising a flexible metallic strip having a free end, a longitudinal direction and recesses disposed one after another in the longitudinal direction; a flexible supply line threaded through the recesses; and a machining or inspection head disposed on the free end and associated with the flexible supply line.

As a result of this measure, a very narrow construction of the flexible lance can be achieved so that even narrow tube gaps can be traveled.

In accordance with another feature of the invention, formations are respectively placed between the recesses in the longitudinal direction of the strip. The formations are for receiving the supply line and extend alternatingly on one side of the strip and then on the other. As a result, it is not necessary to bend the supply line when threading it.

In accordance with a further feature of the invention, the strip is formed of steel.

In accordance with an added feature of the invention, a spray head is provided as the machining device and the supply line is a metallic capillary, in particular a capillary formed of a nickel-titanium alloy.

In accordance with an additional feature of the invention, a fiber optic cable is guided in the strip for an endoscope disposed on the free end of the strip.

In accordance with a concomitant feature of the invention, a cable pull is provided as the supply line for transferring a tensile force to a milling tool disposed on the free end of the strip.

Other features which are considered as characteristic for the invention are set forth in the appended claims.

Although the invention is illustrated and described herein as constructed in a flexible lance for machining or inspecting a tube bottom of a steam generator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
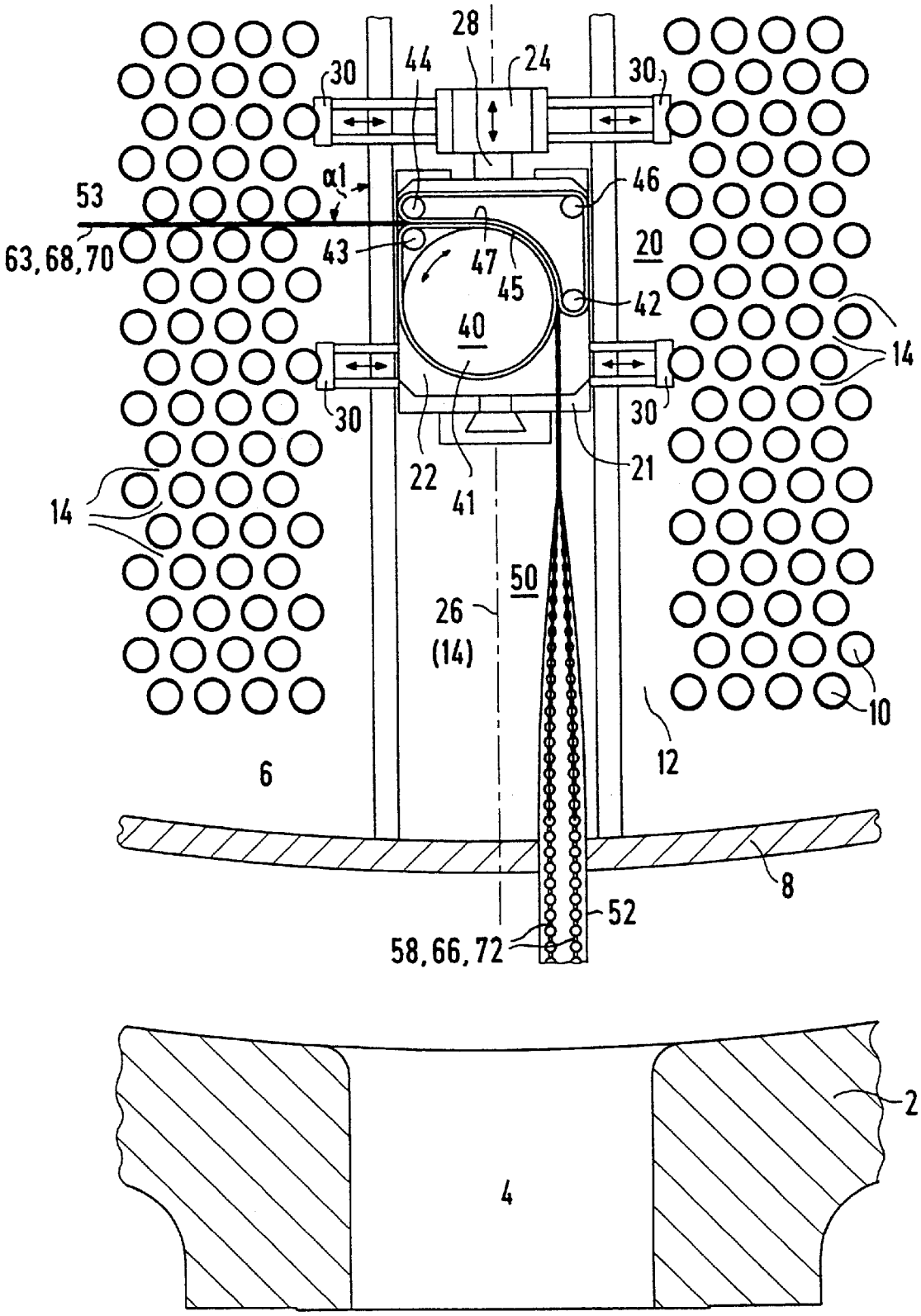
FIGS. 1, 2 and 3 respectively show a fragmentary, diagrammatic top-plan view, a side-elevational view parallel to a tube channel and a side-elevational view crosswise to a tube channel, of a device for actuating a flexible lance according to the invention, in an operating position in a steam generator.

Referring now to the figures of the drawings in detail and first, particularly, to FIG. 1 thereof, there is seen a steam generator 2 in a horizontal partial section at a level of an inspection port 4. A multiplicity of mutually parallel heating tubes 10, which are disposed inside a cylindrical drain channel 8, feed into a tube bottom 6 as can be seen in the top view of FIG. 1. A transport device 20 is introduced through the inspection port 4 into a tube channel 12. A free end 53 of a flexible lance 50 can be inserted from the tube channel 12 into a tube gap 14 running perpendicular to the tube channel 12, with the transport device 20. The steam generator 2 is represented in the figure with a triangular configuration of the heating tubes 10, in which there are particularly narrow tube gaps.

The flexible lance 50 includes a strip 52 on which supply lines 58, 66, 72 are disposed for supplying a machining or inspection head 63, 68, 70 disposed on the free end 53. The transport device 20 includes a slide plate 21 with which it is placed on the tube bottom 6. In order to provide forward motion inside the tube channel 12, a walking mechanism is provided in the transport device 20. That mechanism has been disclosed, for example, in Published European Patent Application 0 084 867 A1, corresponding to U.S. Pat. Nos. 4,572,284 and 4,487,165. For this purpose, the transport device 20 includes two support bodies 22 and 24, which can be moved relative to each other along a longitudinal axis 26 of the transport device through the use of a piston 28 that can be pneumatically actuated. Pairs of pneumatically telescoping support elements 30 are respectively provided on each of the support bodies 22 and 24, and are each supported on heating tubes 10 disposed opposite each other at an edge of the tube channel 12. The transport device 20 moves forward in the tube channel 12 through alternating locking of the support elements 30 and actuation of the piston 28.

A forward feed device 40 is disposed on the transport device 20 and includes a motor-driven driving roller 41 as well as a guide roller 42 which is associated therewith and which is placed against its periphery. The flexible lance 50 is threaded between the drive roller 41 and the guide roller 42.

The forward feed device 40 includes two other guide rollers 43 and 44 which are supported against each other on their periphery, which receive the lance 50 threaded between the drive roller 41 and the guide roller 42 and which adjust it at an angle $\Delta 1$ relative to the longitudinal axis 26 and therefore relative to a central axis 14 of the tube channel 12, which runs parallel thereto. In the example shown in the figure, this angle is 90° so that the lance 50 can be guided into the tube gaps 14.

In the advantageous embodiment represented in the figure, the drive roller 41 and the guide roller 43 are coupled to each other through the use of a continuous strip 45. In the same manner, a strip 47 is likewise guided around the guide rollers 42 and 44 and a deflection roller 46. The strip 47 rests against the strip 45 in the region of the drive roller 41. This measure produces a particularly reliable guidance of the lance 50.

The deflection angle $\alpha 1$ of the lance 50 is determined through the use of the opposing position of the drive roller 41 as well as the guide rollers 42, 43 and 44 on the transport device 20.

In another advantageous embodiment, the forward feed device 40 can additionally be moved relative to the transport device 20, parallel to the longitudinal axis 26, or can be rotated around a vertical axis in order to permit an exact alignment of the flexible lance 50 to the tube gaps 14.

Figure 2:
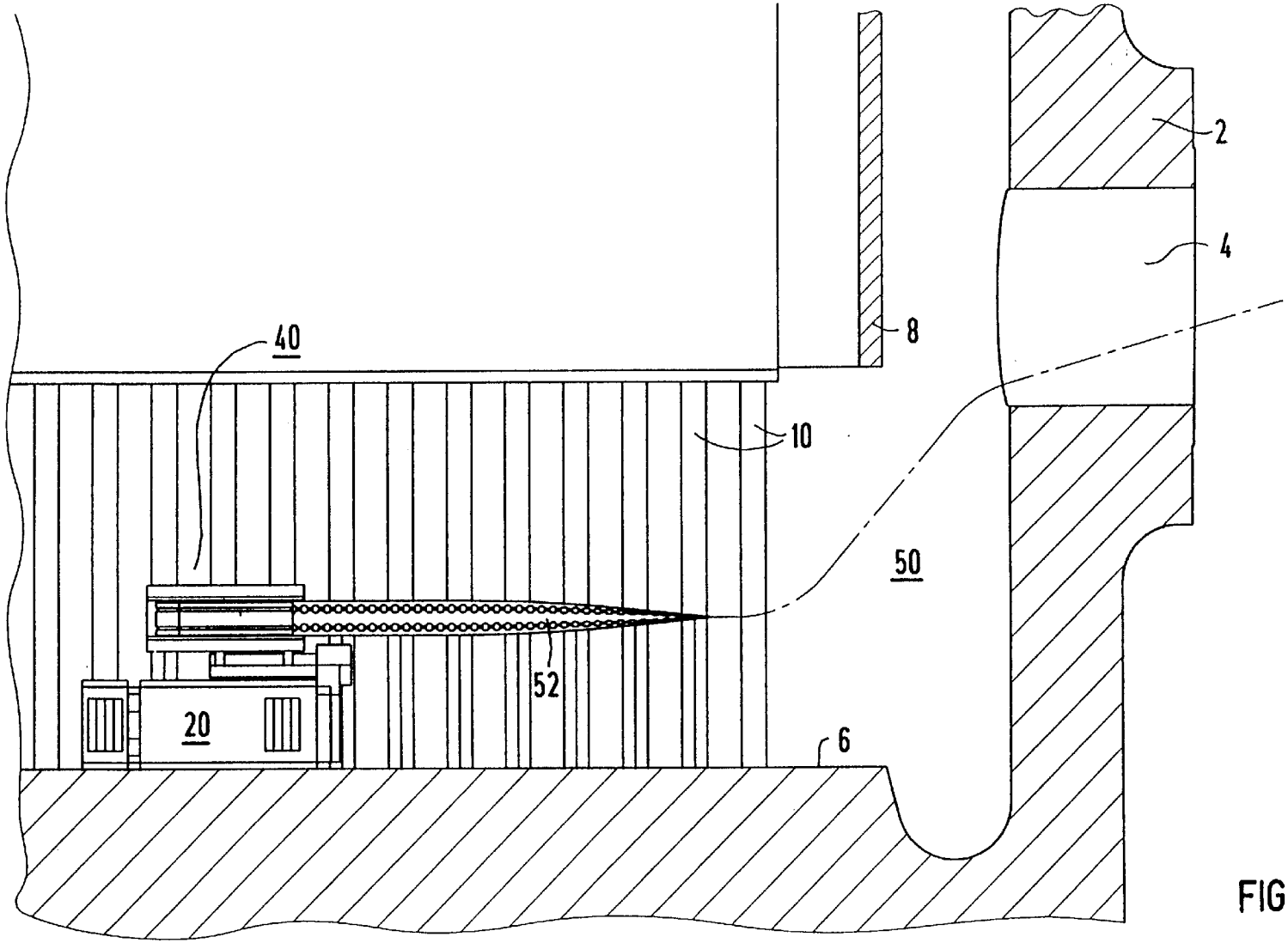

FIG. 2 shows how the lance 50 which is formed of the strip 52 is guided from the outside through the inspection port 4. Since the strip 52 cannot be bent in the plane established by its flat sides and the tube bottom 6 is disposed beneath a bottom edge of the inspection port 4, the strip 52 must be guided with a horizontally aligned flat side through the inspection port 4 and rotated by 90° inside the steam generator 2.

Figure 3:
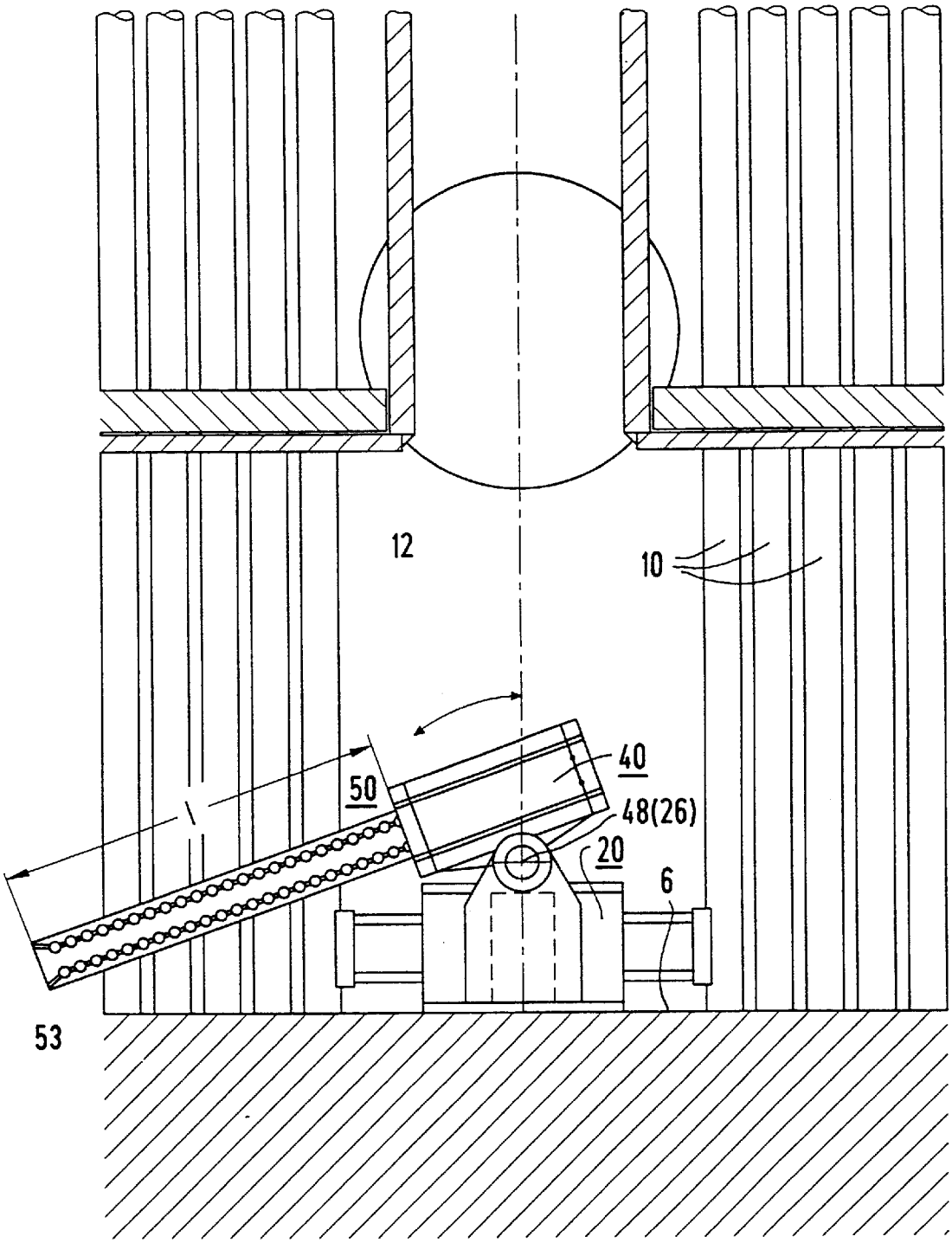

According to FIG. 3, the forward feed device 40 is disposed in the transport device 20 in such a way that it can be pivoted around a rotational axis 48 that runs parallel to the longitudinal axis 26. As a result, the free end 53 of the lance 50 can be positioned directly over the tube bottom 6 even with different telescoping lengths l.

Figure 4:
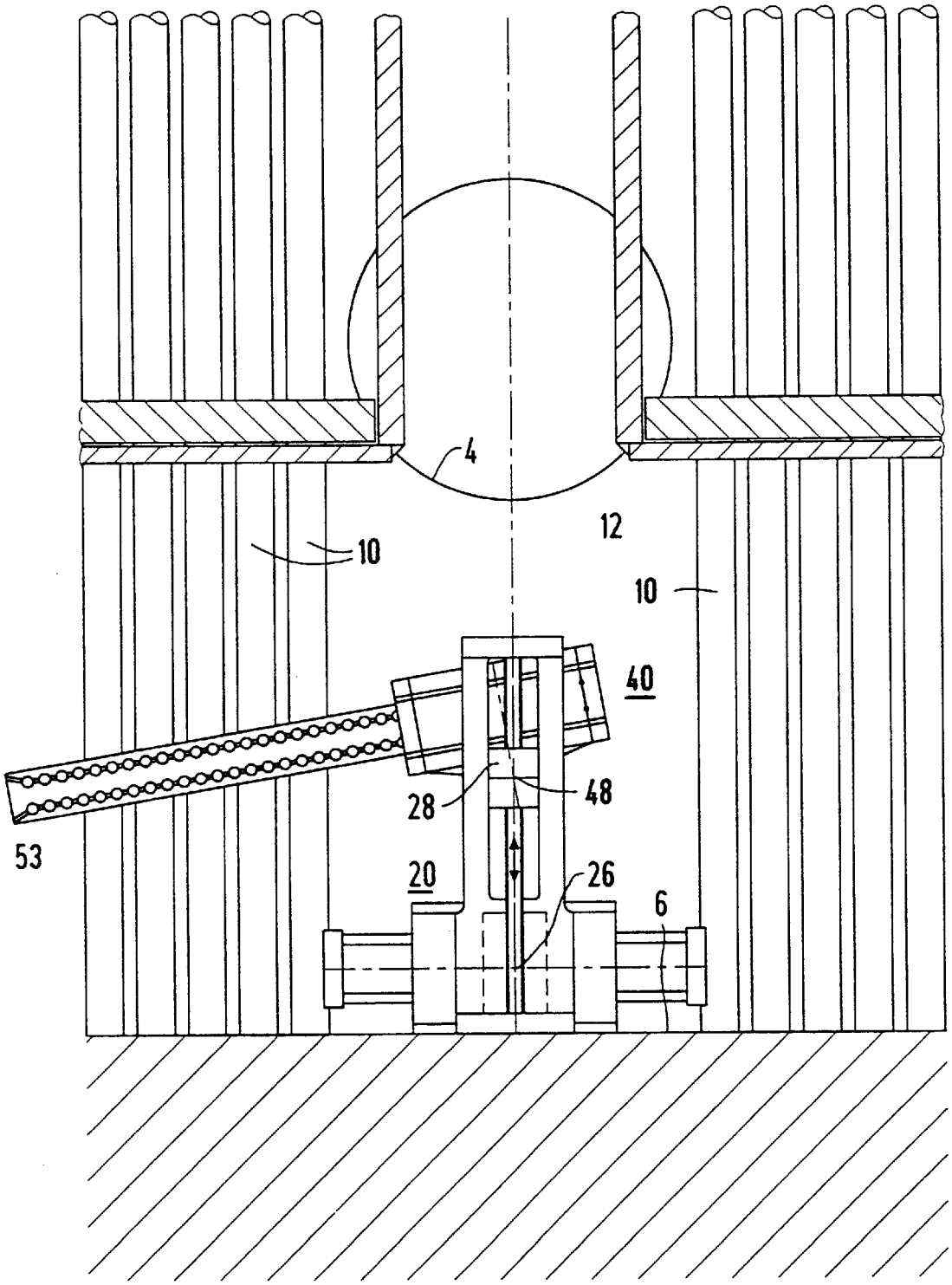
FIGS. 4 and 5 respectively show a fragmentary, side-elevational view crosswise to the tube channel and a top-plan view, of other embodiments of a device for actuating a flexible lance according to the invention inside the steam generator.

In the advantageous embodiment according to FIG. 4, the forward feed device 40 is additionally supported on a sled 28 which permits a vertical adjustment of the forward feed device 40 perpendicular to the longitudinal axis 26 and consequently parallel to the heating tubes 10.

Figure 5:
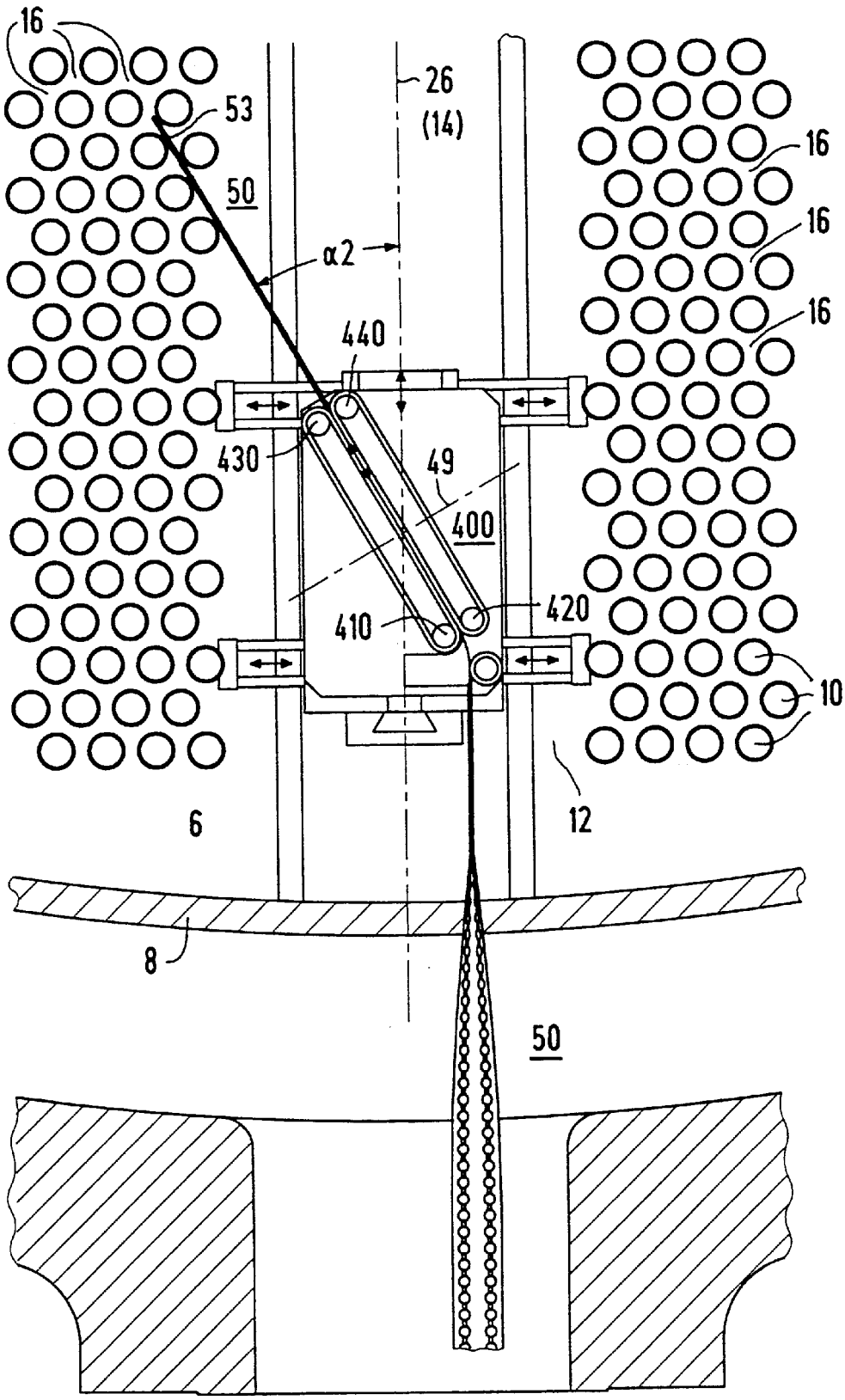

FIG. 5 shows an embodiment in which the lance 50 is aligned at an angle $\alpha 2=30°$ relative to the longitudinal axis 26 of the transport device 20 so that tube gaps 16 extending at an angle of 30° to the center axis 14 of the tube channel 12 can also be traveled by the lance 50. As a result, even dead regions, which can only be engaged with difficulty when traveling at an angle $\alpha 1=90°$, can be reached. In this particular embodiment, a forward feed device 400 is disposed in such a way that it can pivot as a whole around an axis 49 that runs parallel to the tube bottom. Rollers 410, 420, 430 and 440 are also provided in this exemplary embodiment for driving, deflecting and aligning the lance 50. In addition, it can also be advantageous if the entire forward feed device 400 on the transport device 20 is disposed in such a way that it can slide or can pivot around an axis perpendicular to the longitudinal axis 26 in order to permit a precise threading into the tube gaps 16.

Figure 6:
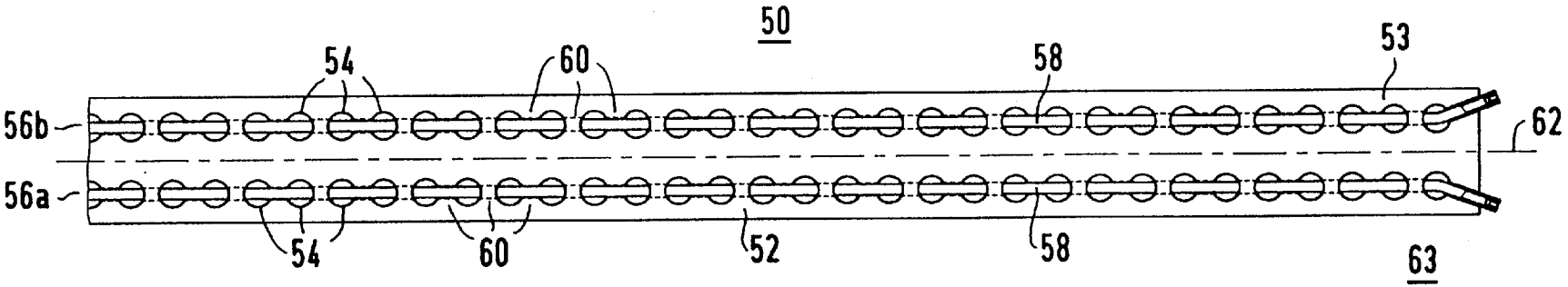
FIGS. 6 and 7 respectively show a fragmentary, side-elevational view (flat side) and a top-plan view (narrow side) of an embodiment of a spray lance according to the invention.
Figure 7:
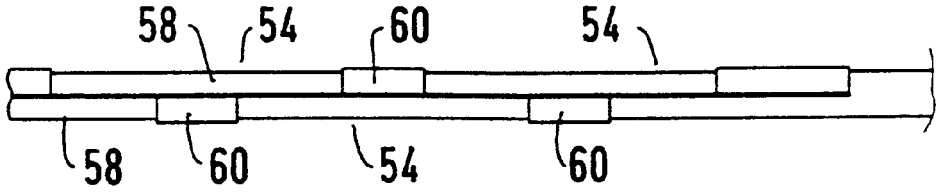

According to FIGS. 6 and 7, the lance 50 contains a flexible metallic strip 52, which is preferably formed of a chromium-nickel steel and has a wall thickness between 0.1 and 0.2 mm. Recesses or holes 54 which are punched into the strip equidistantly one after the other, parallel to its longitudinal direction, form two rows 56*a* and 56*b*. Respective supply lines 58, for example capillaries, are threaded through these rows 56*a* and 56*b* and are provided for a machining head disposed on the free end 53, which in the exemplary embodiment is a spray head 63.

The capillaries 58 are preferably formed of a memory metal that is formed of a nickel-titanium alloy, for example a metal that can be obtained in the trade under the trademark NITINOL SE 502. Its compressive strength is higher than 1000 bar at an outer diameter between 2 and 3 mm.

The capillaries 58 are alternatingly guided through the holes 54 on opposite sides of the strip 52. Fluted formations or beads 60 with a semicircular cross section are stamped into the strip 52 between the holes 54 of a row 56*a* or 56*b* and parallel to a longitudinal axis 62 of the strip 52. The formations 60 are formed one after the other alternatingly on one side of the strip 52 and then on the other. In this way, the formations 60, together with the holes 54 of a row 56*a* or 56*b* form a straight conduit into which the capillaries 58 can be simply slid.

In lieu of the circular holes represented in FIGS. 6 and 7, recesses in the form of narrow slots lateral to the longitudinal axis 62 can be provided, through which the capillaries 58 can be threaded.

Figure 8:
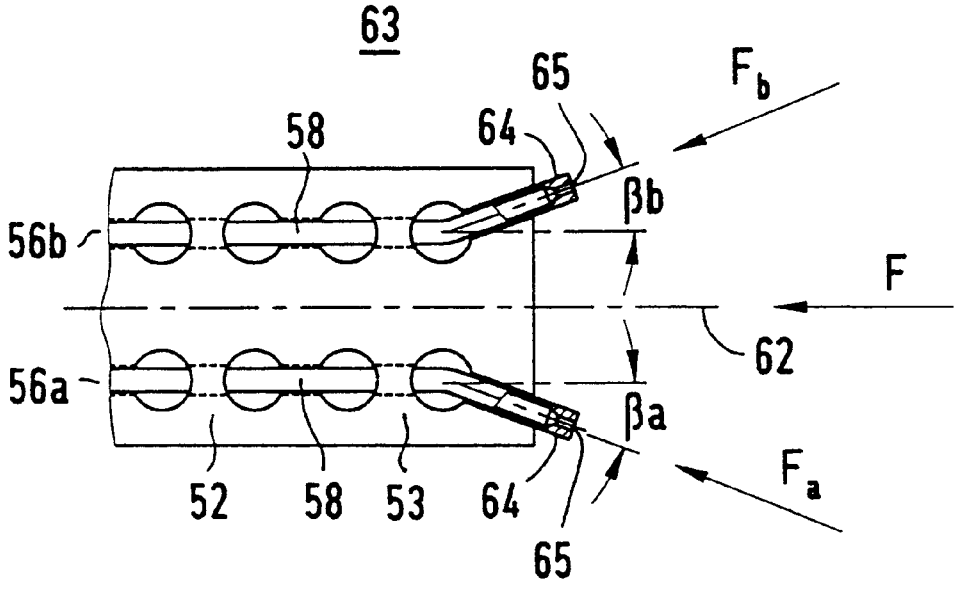
FIG. 8 is an enlarged, fragmentary, side-elevational view of a free end of the spray lance.

According to FIG. 8, when a free end 53 of the strip 52 is constructed as a spray head 63, the capillaries 58 that are respectively associated with the rows 56*a* and 56*b* are bent away from the longitudinal axis 62 of the strip 52 at a respective angle $\beta a$ and $\beta b$, in the plane determined by the flat side of the strip 52. Nozzles 64 are preferably disposed at the ends of the capillaries 58 and emerging spray jets are accelerated in these nozzles and respectively emerge from outlet openings 65 at the angle $\beta a$ or $\beta b$. As a result of the symmetrical disposition of the nozzles 64 relative to the longitudinal axis 62 and their disposition in the strip plane, a sum or a resultant F of reaction forces Fa and Fb exerted on the strip 52 acts virtually parallel to the longitudinal axis 62 of the strip 52. As a result, the strip 52 is prevented from being pressed away from the tube bottom.

Figure 9:
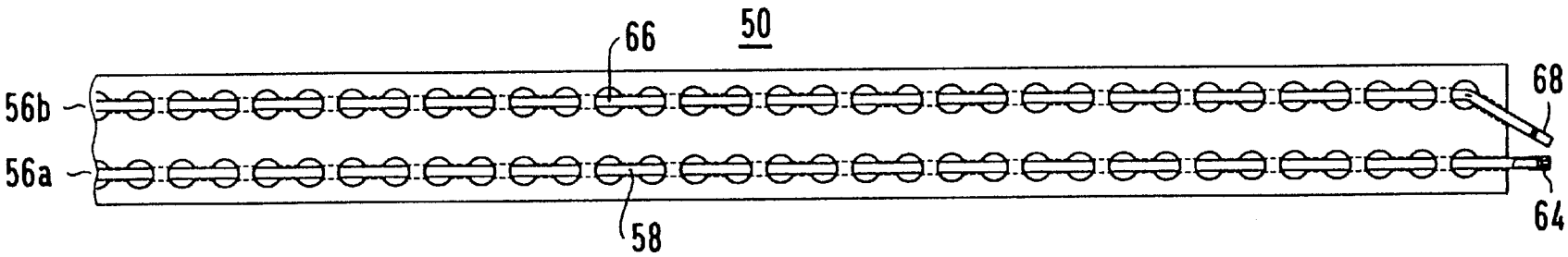
FIGS. 9 and 10 are fragmentary, side-elevational views of other embodiments of a flexible lance.

According to FIG. 9, a fiber optic cable 66 of an endoscope 68, with which the spray process can be observed, is inserted into the conduit 56*b*.

Figure 10:
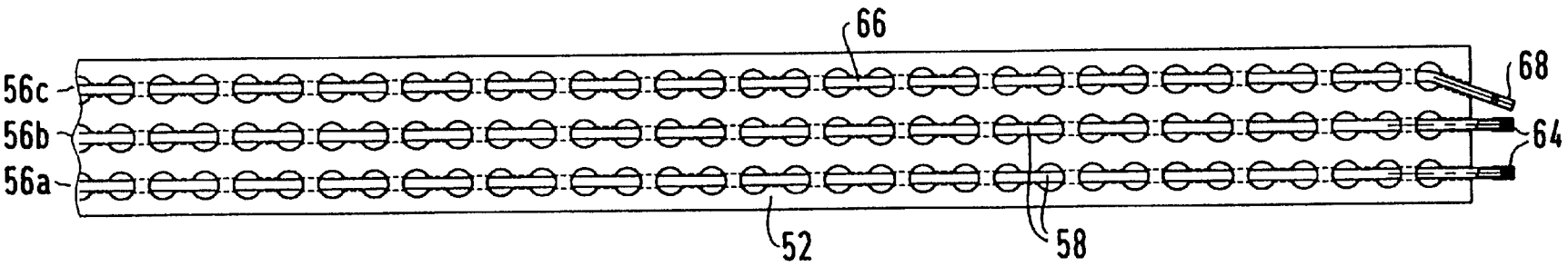

In another embodiment of the invention according to FIG. 10, a strip is provided with three conduits 56*a*, 56*b*, 56*c*. The two conduits 56*a*, 56*b* are each provided with capillaries 58 for spraying, and the conduit 56*c* contains a fiber optic cable 66 of an endoscope 68.

Figure 11:
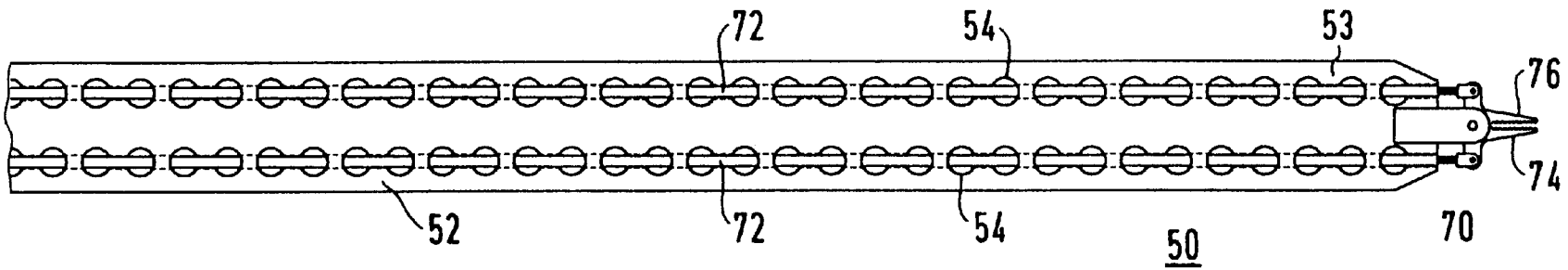
FIG. 11 is a fragmentary, side-elevational view of a flexible lance with a grasping tool as a machining head.

According to FIG. 11, a grasping tool 70, for example, is disposed as a milling tool on the free end 53 of the lance 50. In lieu of capillaries, in this instance, tension cables 72 are guided as supply lines through the holes 54, with which a torque can be exerted on pivotably supported nippers 74 and 76.

We claim:

1. A flexible lance for machining or inspecting a tube bottom of a steam generator, comprising:

a flexible metallic strip having opposite sides, a free end, a longitudinal direction and recesses disposed one after another in the longitudinal direction;

a flexible supply line alternatingly guided through said recesses so that adjacent portions of said supply line are disposed on said opposite sides of said strip; and a machining or inspection head disposed on said free end and associated with said flexible supply line.

2. The flexible lance according to claim 1, wherein said strip has two sides and formations disposed between said recesses in the longitudinal direction of said strip, said formations extended alternately on one and on the other of said sides of said strip.

3. The flexible lance according to claim 2, wherein said strip is formed of steel.

4. The flexible lance according to claim 1, wherein said machining or inspection head is a spray head, and said supply line is a metallic capillary.

5. The flexible lance according to claim 4, wherein said capillary is formed of a nickel-titanium alloy.

6. The flexible lance according to claim 1, wherein said supply line is a fiber optic cable, and said machining or inspection head is an endoscope.

7. The flexible lance according to claim 1, wherein said machining or inspection head is a milling tool, and said supply line is a cable pull for transferring a tensile force to said milling tool.

* * * * *